US009617658B2

(12) United States Patent
Boscolo

(10) Patent No.: US 9,617,658 B2
(45) Date of Patent: Apr. 11, 2017

(54) APPARATUS FOR SPINNING FIBRES AND PRODUCING A FIBROUS-CONTAINING NONWOVEN

(75) Inventor: Galliano Boscolo, Vigliano Biellese (IT)

(73) Assignee: BOMA Engineering SRL, Milan (IT)

( * ) Notice: Subject to any disclaimer, the term of this patent is extended or adjusted under 35 U.S.C. 154(b) by 605 days.

(21) Appl. No.: 13/816,079

(22) PCT Filed: Aug. 10, 2011

(86) PCT No.: PCT/EP2011/063770

§ 371 (c)(1),
(2), (4) Date: Apr. 9, 2013

(87) PCT Pub. No.: WO2012/020053

PCT Pub. Date: Feb. 16, 2012

(65) Prior Publication Data

US 2013/0189892 A1 Jul. 25, 2013

Related U.S. Application Data

(60) Provisional application No. 61/468,118, filed on Mar. 28, 2011.

(30) Foreign Application Priority Data

Aug. 12, 2010 (EP) ..... 10172606

(51) Int. Cl.
*D01D 5/098* (2006.01)
*D01D 5/14* (2006.01)
(Continued)

(52) U.S. Cl.
CPC ..... *D01D 5/0985* (2013.01); *D01D 4/02* (2013.01); *D01D 4/025* (2013.01); *D01D 5/088* (2013.01);
(Continued)

(58) Field of Classification Search
CPC ..... D01D 4/02; D01D 4/025; D01D 5/088; D01D 5/092; D01D 5/098; D01D 5/0985;
(Continued)

(56) References Cited

U.S. PATENT DOCUMENTS 3,849,241 A 11/1974 Butin et al.
4,048,364 A 9/1977 Harding et al.
(Continued)

FOREIGN PATENT DOCUMENTS

CN 1757800 4/2006
CN 1920149 2/2007
(Continued)

OTHER PUBLICATIONS

Examination Report dated May 23, 2014 from corresponding Australian patent application Serial No. 2011288452 (five pages).
(Continued)

*Primary Examiner* — Yogendra Gupta
*Assistant Examiner* — Joseph Leyson
(74) *Attorney, Agent, or Firm* — Harness, Dickey & Pierce, PLC

(57) ABSTRACT

The apparatus (1) is used for producing melt-blown fibres (MF). It comprises a die head (104) with several spinning orifices, means (100, 101,102, 103) for extruding at least one melted polymeric material through the spinning orifices of the die head (104) in the form of meltblown filaments (f), and means (104*a*,104*b*) for blowing a hot primary gas flow (F1) towards the outlet of the die head (104) in order to draw and attenuate the polymeric filaments (f) at the outlet of the die head, and a drawing unit (105) that is positioned below the die head (104), and that is adapted to create an additional gas flow (F3) that is oriented downstream to further draw and attenuate the meltblown filaments (f).

18 Claims, 7 Drawing Sheets

(51) Int. Cl.

| | |
|---|---|
| ***D04H 1/56*** | (2006.01) |
| ***D01D 5/092*** | (2006.01) |
| ***D01D 4/02*** | (2006.01) |
| ***D01D 5/088*** | (2006.01) |
| ***D01D 5/253*** | (2006.01) |
| ***D04H 3/03*** | (2012.01) |

(52) U.S. Cl.
CPC ..... *D01D 5/092* (2013.01); *D01D 5/098* (2013.01); *D01D 5/14* (2013.01); *D01D 5/253* (2013.01); *D04H 1/56* (2013.01); *D04H 3/03* (2013.01); *Y10T 442/608* (2015.04); *Y10T 442/609* (2015.04); *Y10T 442/611* (2015.04)

(58) Field of Classification Search
CPC D01D 5/14; D01D 5/253; D04H 1/56; D04H 3/03
See application file for complete search history.

(56) References Cited

U.S. PATENT DOCUMENTS

| | | | | |
|---|---|---|---|---|
| 4,724,114 | A | 2/1988 | McFarland et al. | |
| 4,931,355 | A | 6/1990 | Radwanski et al. | |
| 4,939,016 | A | 7/1990 | Radwanski et al. | |
| 5,075,068 | A | 12/1991 | Milligan et al. | |
| 5,075,161 | A * | 12/1991 | Nyssen | D01D 5/0985 264/14 |
| 5,648,041 | A * | 7/1997 | Rodgers | D01F 9/145 264/103 |
| 5,863,565 | A * | 1/1999 | Rossillon | D01D 5/0985 264/12 |
| 5,993,714 | A | 11/1999 | Sawyer et al. | |
| 6,368,533 | B1 * | 4/2002 | Morman | B29C 35/0261 264/103 |
| 6,417,120 | B1 | 7/2002 | Mitchler et al. | |
| 6,692,868 | B2 | 2/2004 | Zucker | |
| 2001/0026815 | A1 * | 10/2001 | Suetomi | D01D 4/025 425/7 |
| 2003/0116874 | A1 * | 6/2003 | Haynes | 264/40.3 |
| 2005/0136144 | A1 | 6/2005 | Haynes et al. | |
| 2006/0061006 | A1 | 3/2006 | Frey et al. | |

FOREIGN PATENT DOCUMENTS

| | | |
|---|---|---|
| CN | 101636532 | 1/2010 |
| EP | 0 474 421 A2 | 3/1992 |
| EP | 0 608 884 | 5/1998 |
| EP | 1 637 632 A1 | 3/2006 |
| EP | 1 101 854 | 11/2007 |
| EP | 2 119 816 A1 | 11/2009 |
| JP | 2001-146670 | 5/2001 |
| JP | 3594983 | 9/2004 |
| UA | 27393 | 10/2007 |
| UA | 30873 | 3/2008 |
| WO | WO-99/32692 A1 | 7/1999 |
| WO | WO-02/08502 A1 | 1/2002 |

OTHER PUBLICATIONS

First Office Action dated Jan. 6, 2015 from corresponding Chinese patent application Serial No. 2011800496054 with English translation (thirty-four pages).
Search Report dated Feb. 9, 2015 from corresponding European patent application Serial No. 14184007 (five pages).
International Search Report and Written Opinion for PCT/EP2011/063770, mailed Oct. 28, 2011; ISA/EP.
European Search Report for EP 10 17 2606.5, completed Feb. 22, 2011; Munich.
Office Action mailed Aug. 18, 2015 in corresponding JP Application No. 2013-523608.

* cited by examiner

APPARATUS FOR SPINNING FIBRES AND PRODUCING A FIBROUS-CONTAINING NONWOVEN

CROSS-REFERENCE TO RELATED APPLICATIONS

This application is 371 U.S. National Stage of International Application No. PCT/EP2011/063770, filed on Aug. 10, 2011, and claims priority to European Patent Application No. 10172606.5, filed on Aug. 12,2010, and the benefit of U.S. Provisional Application No. 61/468,118, filed on Mar. 28, 2011. The contents of the above applications are herein incorporated by reference in their entirety.

TECHNICAL FIELD

The present invention relates to the field of fibres spinning. In this field, the invention mainly relates to a novel improved process and apparatus for spinning fibres, and to a novel process and apparatus for producing a fibrous-containing nonwoven, and in particular pulp-containing meltblown nonwoven.

PRIOR ART

A well-known technology for spinning fibres and making a nonwoven is the so-called meltblown technology. A process and apparatus for manufacturing a meltblown nonwoven are well-known and described for example in U.S. Pat. No. 3,849,241 to Butin et al, and in U.S. Pat. No. 4,048,364 to Harding et al.

Basically, the well-known process for manufacturing a meltblown nonwoven involves extruding a molten polymeric material through a die head into meltblown polymeric filaments, and attenuating these filaments by converging flows of a high velocity heated gas (usually air), hereafter called "primary air". This primary air is heated at a temperature which is typically equal or slightly greater than the melt temperature of the polymer. This hot primary air draws and attenuates the polymeric filaments immediately at the outlet of the die head. In a meltblown process, the drawing force for attenuating the meltblown filaments is thus applied immediately at the outlet of the die head while the polymer is still in the molten state. At the outlet of the die head, a large volume of cooling air, hereafter called "secondary air" is drawn into the primary air. This secondary air is cooling down the meltblown filaments downstream from the die head and provides the quenching of the meltblown filaments.

Generally, in a meltblow process, the primary air is also adjusted in such way that the meltblown filaments are broken at the outlet of the die head into discontinuous fibres (microfibres or nanofibres) of shorter length. The discontinuous fibres generally have a length exceeding the typical length of staple fibres. More particularly, to date with a standard known meltblow process, discontinuous meltblown fibres having a length between 5 mm and 20 mm can be produced.

The meltblown fibres are delivered downstream from the die head onto a moving surface, like for example a cylinder or conveyor belt, in order to form a meltblown nonwoven web of unoriented meltblown fibres. Preferably, the forming surface is air permeable, and even more preferably suction means are provided for sucking the fibres onto the forming surface. This meltblown nonwoven web can then be transported to consolidating means, like for example thermal bonding calendar, a water needling unit, an ultrasonic bonding unit, in order to form a consolidated meltblown nonwoven web.

With a standard meltblow process, meltblown nonwovens made of very fine denier fibres can be advantageously produced. Typically, the average diameter of meltblown fibres can be less than 10 μm. As a result, meltblown nonwovens of low air permeability and good coverage can be advantageously obtained.

In return, the meltblown technology has several limitations and drawbacks.

During a standard meltblow process, the meltblown fibres have been submitted only to a small stretching, and the meltblown fibres thus exhibit a low tenacity. The meltblown nonwovens have thus generally poor mechanical properties, and in particular exhibit a low tenacity, a low mechanical tensile strength in the machine direction and in the cross direction, and a low elasticity.

In addition, in a standard meltblow process, the velocity of the primary air has to be adjusted, in order to achieve the required attenuation of the meltblown filaments as well as the appropriate breaking of the meltblown filaments into discontinuous meltblown fibres of predetermined average length. In practice, in order to obtain a sufficient attenuation of the meltblown filaments and produce fine denier meltblown fibres, the velocity of the primary air has to be sufficiently high, which also leads to the production of shorter meltblown fibres. In a standard meltblow process the adjustment of the average diameter and length of the meltblown fibres is thus difficult and not very flexible. In particular, it is for example difficult to produce meltblown polypropylene fibres having a very small diameter, typically less than 10 μm, and having a long length, for example higher than 20 mm.

To date, in the standard meltblown technology, only polymer of high melt flow index, typically between 600 and 2000, can be processed. Even though a spinneret having non circular spinning orifices, and for example bilobal shaped orifices, is being used, this high melt flow index combined with the stretching of the filament leads to a deformation in cross section of the filament, and the filament shape conferred by the spinning orifices cannot be maintained. Actually, it is possible in practice to produce meltblown filaments having only a substantially circular shape in cross section, In U.S. Pat. No. 5,075,068, it is proposed to discharge an additional crossflow air toward the meltblown filaments to disrupt their shape by creating an undulation in the filaments. This undulation would enhance the drag forces imparted by the primary meltblown air. To the knowledge of the inventor, such a technology has never been commercialized and the undulation of the filaments by the crossflow air seems to be difficult to control, and could lead to detrimental undulation of the filaments.

A consolidated meltblown nonwoven can be used alone for making a textile product or can be used in a laminate comprising additional layers, such as for example other nonwoven web(s) [meltblown web(s), spunbonded web(s), carded web(s), air-laid web(s)] and/or additional fibrous layer(s), such as for example fibrous layer(s) made of wood-pulp fibres, and/or additional plastic film(s). The laminate can be consolidated by any known consolidating means, including thermal bonding, mechanical bonding, hydroentangling, ultrasonic bonding, air-through bonding, and adhesive bonding.

More particularly, for making a laminate having high absorbency properties, it is known to laminate a meltblown nonwoven with at least one layer of fibrous material having high absorbency capacity, such as for example a layer of short wood-pulp fibres. This layer of wood-pulp fibres can also be mixed with particles, such as particles made of super absorbent material.

One important drawback of such a laminate is the low cohesion between the fibrous layer and the meltblown nonwoven prior to or even after the consolidation step of the laminate. This low cohesion leads to high and detrimental loss of fibrous material (e.g. wood-pulp fibres).

A process for producing a fibrous-containing meltblown nonwoven, and more particularly a pulp-containing meltblown nonwoven is also known in the prior art and is disclosed for example in U.S. Pat. No. 4,931,355 and in U.S. Pat. No. 4,939,016 to Radwanski et al. The fibrous material, e.g. wood pulp, is fed directly into the polymer streams immediately downstream from the outlet of the meltblow die head.

In such a process, due to the high velocity of the polymer streams at the outlet of the die head, it is actually difficult to reliably incorporate the fibrous material inside the meltblown filaments that are extruded through the die head. As a result, during the manufacturing process, a large quantity of fibrous material is not incorporated inside the meltblown filaments, and is on the contrary pushed back by the air flow that surrounds the meltblown filaments downstream from the die head. Furthermore, in the fibrous-containing meltblown nonwoven that is obtained with such a process, the fibrous material is not strongly intermingled with the meltblown fibres, and the bonding of the fibrous material with the meltblown fibres is low. This low bonding leads to high loss of fibrous material when the fibrous-containing meltblown nonwoven is subsequently transported or handled. This loss of fibrous material is even more important and detrimental in case the fibrous-containing meltblown nonwoven is submitted to a subsequent hydro-entanglement step, as described in aforesaid U.S. Pat. Nos. 4,931,355 and 4,939,016.

SUMMARY OF THE INVENTION

A first objective of the invention is to propose a novel improved technical solution for spinning meltblown fibres.

The apparatus for producing meltblown fibres comprises a die head with several spinning orifices, means for extruding at least one melted polymeric material through the spinning orifices of the die head in the form of meltblown filaments, and means for blowing a hot primary gas flow towards the outlet of the die head in order to draw and attenuate the polymeric filaments at the outlet of the die head, and a drawing unit positioned below the die head, and adapted to create an additional gas flow that is oriented downstream for further drawing and attenuating the meltblown filaments.

The process comprises the following steps:

(i) extruding through spinning orifices of a die head at least one melted polymeric material in order to form polymeric meltblown filaments, (ii) drawing and attenuating the meltblown filaments at the outlet of the die head, by means of a hot primary gas flow, (iii) using a drawing unit positioned below the died head for generating an additional gas flow that is oriented downstream, in order to further draw and attenuate the meltblown filaments. A second objective of the invention is to propose a novel improved technical solution for making a fibrous-containing nonwoven, said novel improved technical solution notably overcoming the aforesaid drawbacks of the solution discloses in U.S. Pat. No. 4,931,355 and in U.S. Pat. No. 4,939,016 to Radwanski et al.

The spinning apparatus for making a fibrous-containing nonwoven, comprises a die head with several spinning orifices, means for extruding at least one melted polymeric material through the spinning orifices of the die head in the form of filaments, and a drawing unit positioned below the die head, and adapted to create a gas flow that is oriented downstream for drawing and attenuating the filaments, the apparatus further comprising supplying means for continuously feeding a stream of fibrous material at a position between the die head and the drawing unit, and nearby the filaments.

The spinning process for making a fibrous-containing nonwoven comprises the following operations:

(i) at least one melted polymeric material is extruded through spinning orifices of a die head in order to form polymeric filaments, (ii) a drawing unit positioned below the died head is used for generating a gas flow that is oriented downstream, in order to draw and attenuate the filaments (iii) fibrous material is continuously fed at a position between the die head, and the drawing unit, and nearby the filaments.

A third objective of the invention is to propose a novel improved technical solution for spinning discontinuous fibres.

The apparatus for spinning discontinuous fibres comprises a die head with several spinning orifices, means for extruding at least one melted polymeric material through the spinning orifices of the die head in the form of filaments, and a drawing unit positioned below the die head, and adapted to create a gas flow (F3) that is oriented downstream for drawing and attenuating the filaments (f), and for breaking the filaments into discontinuous fibres.

In the process for producing discontinuous fibres (MF):

(i) at least one melted polymeric material is extruded through spinning orifices of a die head in order to form polymeric filaments, (ii) a drawing unit positioned below the died head is used for generating a gas flow that is oriented downstream, in order to draw and attenuate the filaments and in such a way to break the filaments into discontinuous fibres.

The word "fibres" as used therein and in the claims encompasses long continuous fibres (also commonly referred as "filaments") and shorter discontinuous fibres.

The word "downstream" used therein and in the claims means that the gas flow is oriented substantially in the direction of the polymer flow.

Another object of the invention is a nonwoven comprising at least one layer of non-staple fibres having a shaped cross-section and having an average length of not more than 250 mm.

More particularly, the said layer also comprises fibrous material intermingled with the non-staple fibres.

The fibrous material can advantageously comprise absorbent pulp fibres.

The wording "non-staple fibres" used therein and in the claims defines discontinuous fibres that have been obtained by stretching polymeric filaments in such a way to break the filaments during their extrusion, in contrast with so-called "staple fibres" which are obtained by mechanically cutting filaments after their extrusion process notably by using cutting blades.

Staple fibres have generally the same length and are previously crimped before cutting. In contrast, the non-staple fibres have different lengths due to their random breaking during their extrusion and are generally not crimped.

The wording "shaped fibres" or "shaped cross section" used therein and in the claims means fibres having a cross section that is not circular.

Another object of the invention is the use of such a nonwoven for making absorbent products, and more particularly dry or wet wipes, diapers, training pants, sanitary napkins, incontinence products, bed pads.

BRIEF DESCRIPTION OF THE DRAWINGS

Other characteristics and advantages of the invention will appear more clearly on reading the following description of preferred embodiments of the invention, which description is given by way of non-limiting example and is made with reference to the accompanying drawings, in which.

DETAILED DESCRIPTION

Figure 1:
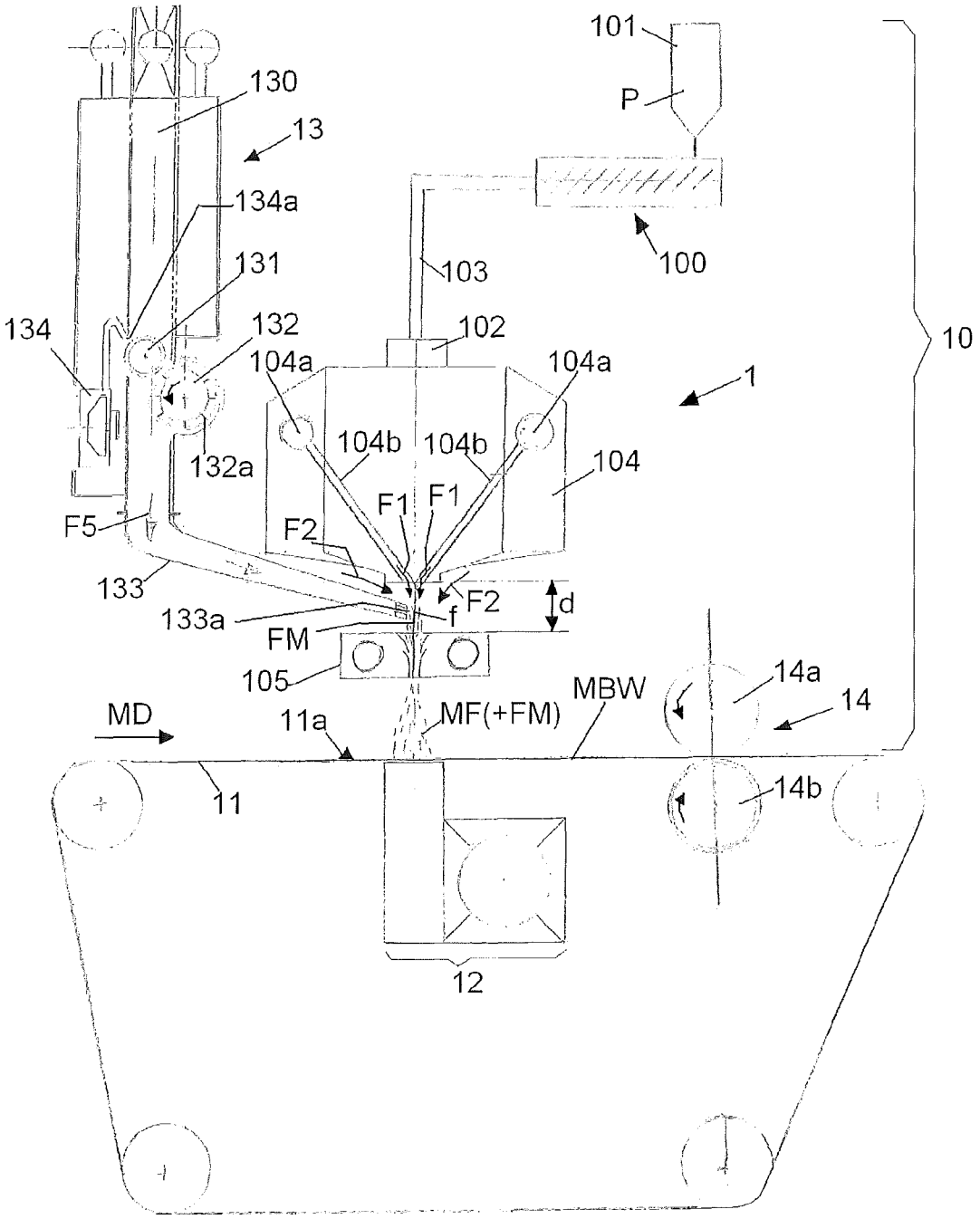
FIG. 1 is a schematic representation of an apparatus according to a first embodiment of the invention, and adapted to produce a novel fibrous-containing meltblown nonwoven.

In reference to FIG. 1, the apparatus 1 comprises a meltblow equipment 10 for spinning polymeric meltblown fibres MF and a conveyor belt 11 for catching the meltblown fibres MF issued from the meltblow unit 10. This conveyor belt 11 is air permeable and is knowingly associated with a suction device 12 for sucking the meltblown fibres MF onto a surface 11*a* of the conveyor belt 11. In operation, the surface 11*a* of the conveyor belt 11 is moved in machine direction MD, in such way that a meltblown nonwoven web MBW is formed on the surface 11*a* from at least the meltblown fibres MF that are randomly laid onto the surface 11*a*.

As already known in the art, the meltblow equipment 10 comprises:

- an extruder 100,
- a hopper 101 containing polymeric pellets P, said hopper 101 being connected to the extruder 100 and being adapted to supply by gravity the extruder 100 with polymeric pellets P,
- a spinning pump 102 connected to the outlet of the extruder via a duct 103,
- a meltblow die head 104 that knowingly comprises one or several parallel rows of spinning orifices that extend in the cross direction (direction perpendicular to FIG. 1) and air blowing means 104*a*, 104*b* for converging heated air flows F1 (hereafter called "hot primary air") towards the outlet of the die head 104 formed by the spinning orifices.

These components 100 to 104 of the meltblow equipment 10 are already known in the art and will not be described in details.

In operation of the meltblow equipment 10, the polymeric pellets P are melted by the extruder 100 into a molten polymeric material, which is fed by the extruder 100 to the spinning pump 102. Said spinning pump 102 feeds the die head 104 in order to extrude the molten polymeric material through the spinning orifices of the die head 104, and to form at the outlet of the die head 104 a vertical curtain of polymeric meltblown filaments f. This vertical curtain of polymeric meltblown filaments f extends in the cross direction perpendicular to the plane of FIG. 1.

The hot primary air (heated air flows F1) is drawing and attenuating the meltblown filaments f immediately at the outlet of the die head 104, while the polymer is still in the molten state. This hot primary air F1 is typically heated at a temperature which is substantially equal or slightly higher than the melt temperature of the polymer. At the outlet of the die head, a large volume of cooling air (air flows F2), hereafter called "secondary air" is drawn into the primary air. This secondary air F2 is cooling down the polymeric filaments f downstream from the die head 104 and provides the quenching of the polymeric meltblown filaments f.

The meltblow equipment 10 newly comprises an additional air-drawing unit 105 that is positioned below the die head 104, and that is adapted to further draw and attenuate the polymeric meltblown filaments f. Preferably, but not necessarily, the distance d between the outlet of the die head 104 and the inlet of the air-drawing unit 105 is adjustable.

Figure 2:
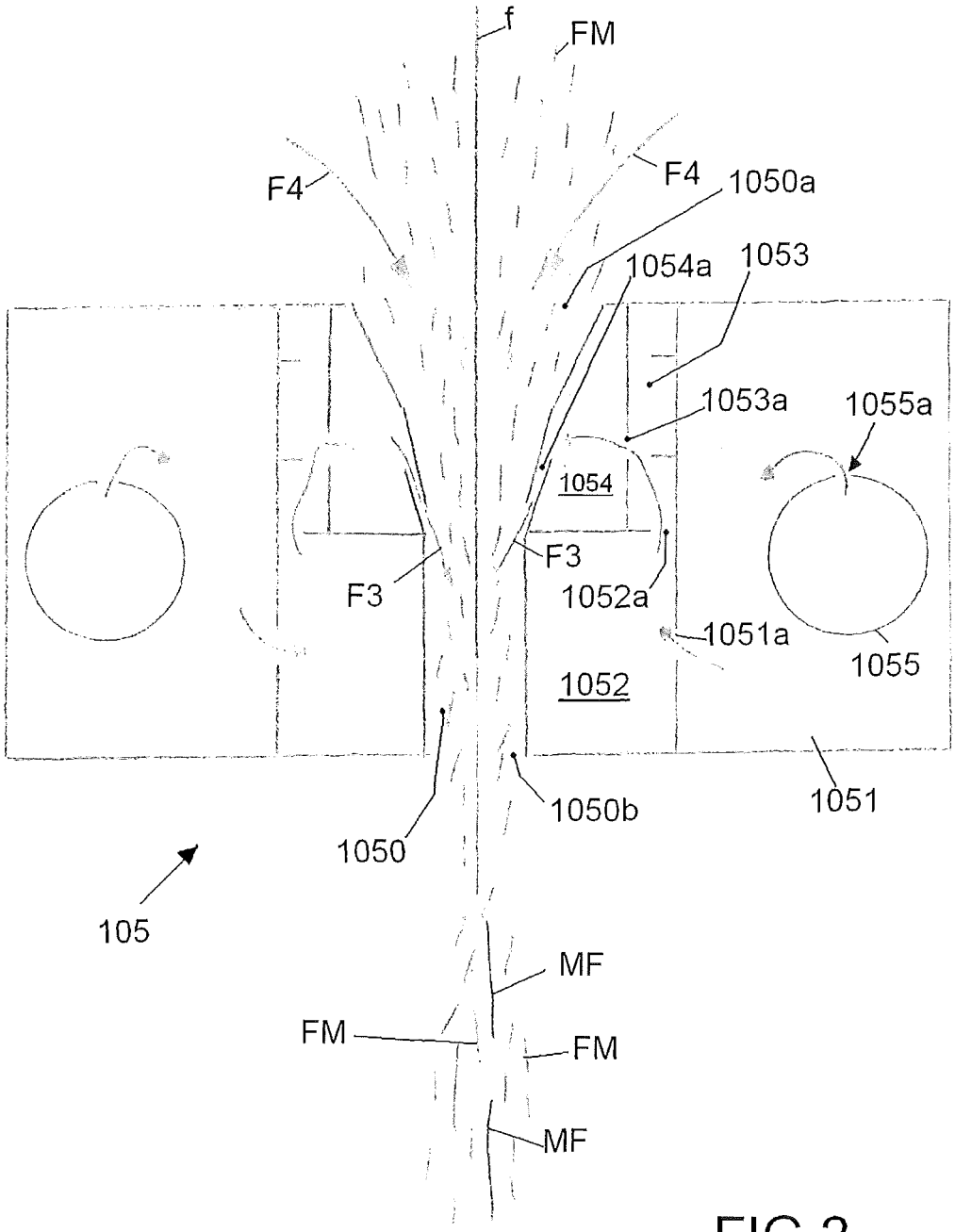
FIG. 2 is a detailed view in cross-section of an example of air-drawing unit that can be used in the apparatus of FIG. 1.

FIG. 2 shows a particular embodiment of a suitable air-drawing unit 105. The invention is however not limited to the particular structure of FIG. 2 and encompasses any drawing unit that can be used for continuously draw and attenuate the polymeric meltblown filaments f, in particular by means of gas flows.

In reference to the particular embodiment of FIG. 2, the drawing unit 105 comprises a vertical channel 1050 having an upper longitudinal slot-type inlet 1050*a* and a lower longitudinal slot-type outlet 1050*b* that both extend in the cross direction (direction perpendicular to FIG. 2). This channel 1050 is vertically aligned with the outlet (row of spinning orifices) of the die head 4, in such a way that the curtain of meltblown filaments f passes through the channel 1050. On each side of the channel 1050, the drawing unit 105 comprises successively four chambers 1051, 1052, 1053, 1054 that communicate through longitudinal slot-type openings 1051*a*, 1052*a*, 1053*a*. The last chamber 1054 is communicating with the channel 1050 through a longitudinal slot-type outlet 1054*a*. The first chamber 1051 is housing a longitudinal blowing duct 1055 that comprises a longitudinal slot-type outlet 1055*a*.

In operation, the blowing duct 1055*a* is supplied with gas under pressure at ambient temperature, and more particularly with air under pressure at ambient temperature. This air is exhausted in chamber 1051 through the slot-type outlet 1055*a*, and then passes successively in the chambers 1052, 1053 and 1054. This air under pressure is exhausted in the channel 1050, through the slot-type outlet 1054*a*, in the form of downward air flows F3 of high velocity. Each slot-type outlet 1054*a* is inclined in such a way that the air flows F3 are oriented downstream and substantially in the longitudinal direction of the filaments f, i.e. substantially in the same longitudinal downstream direction as the flow of polymer forming the filaments f.

In operation, the polymeric meltblown filaments f are passing through the channel 1050 of the drawing unit 105 and are drawn and attenuated by the air flows F3 (FIG. 2), that are blown at ambient temperature into the channel on each side of the curtain of meltblown filaments f, substantially in the longitudinal direction of the filaments f. These air flows F3 are also cooling down the filaments F, and thus contribute also to the solidification (quenching) of the filaments f.

The high velocity air flows F3 also create by Venturi effect an air suction above the drawing unit 105. This air suction creates additional air flows F4 that are sucked into the channel 1050 through the inlet 1050*a*, and that contribute to the cooling and solidification of the filaments f.

In the drawing unit 105, the airflows do not create turbulences that would impart a flapping movement or that would create undulations in the filaments. In the drawing unit 105, the filaments remain straight and do no have any flapping movement.

The velocities of the air flows F1 (died head 104) and F3 (drawing unit 105) can be advantageously selected in such a way to break the filaments f at the outlet 1050*b* of the drawing unit 105 and to form discontinuous meltblown fibres MF having a predetermined average length (FIG. 2).

The velocities of the air flows F1 and F3 can be advantageously adjusted separately, which improves the flexibility of the setting of the meltblow equipment 10.

More particularly, in the invention the distance between the drawing unit 105 and the outlet of the die head 104 can be adjusted in order to break the filaments f and form discontinuous non-staple fibres of specific average length. Preferably, the distance between the drawing unit 105 and the outlet of the die head 104 can be adjusted in order to break the filaments f and form discontinuous non-staple fibres having an average length of not less than 20 mm, preferably higher than 40 mm, and of not more than 250 mm, and preferably of not more than 150 mm.

Thanks to the use of this additional drawing unit 105, the stretching of the polymer chains of the filaments f can be greater than the usual stretching practised in a standard meltblow equipment, which advantageously enables to increase the tenacity of the meltblown fibres MF, and thereby the tenacity and MD (Machine Direction) tensile strength of the meltblown nonwoven web MBW comprising such fibres.

In the invention, the air drawing unit 105 can be used and adjusted in order to produce very fine denier fibres MF having an average diameter less than 10 μm, and preferably less than 2 μm, but can also be advantageously used and adjusted in order to produce thicker discontinuous non-staple fibres MF having an average diameter of not less than 10 μm, and preferably between 10 μm and 400 μm.

In another variant of the invention, the velocities of the air flows F1 (died head 104) and F3 (drawing unit 105) can also be advantageously selected in such a way that the filaments f of the drawing unit 105 are not broken at the outlet 1050*b* and thus form continuous meltblown fibres MF.

Thanks to the use of the air drawing unit 105, the polymer(s) used for making the filaments can advantageously have a low melt flow index, and in particular a melt flow index between 15 and 70 (ASTM D1238). It is thus possible to spin shaped fibres having a non-circular cross section, but having form example a multilobal cross section, in particular a bilobal cross section.

In the embodiment of FIG. 1, the apparatus 1 also comprises supplying means 13 for feeding a stream of fibrous material FM at a position between the die head 104 and the drawing unit 105, in order to continuously incorporate fibrous material FM in the curtain of polymeric meltblown filaments f that are extruded from the die head 104.

The terms "fibrous material" used therein and in the claims encompass any material comprising short length fibres and/or comprising particles.

The average length of the fibres of the fibrous material FM will generally not exceed the average length of the meltblown fibres MF. But fibres for the fibrous material, having an average length that is greater than the length of the meltblow fibres MF can be however also used.

More particularly, the fibrous material can advantageously comprise "pulp".

The term "pulp" as used therein and in the claims refers to absorbent material made of or containing fibres from natural sources such a as woody and non-woody plants. Woody plants (i.e. wood-pulp) include, for example, deciduous and coniferous trees. Non-woody plants include, for example, cotton, flax, esparto grass, milkweed, straw, jute hemp, and bagasse. Typically, the average length of the pulp fibres is not more than 5 mm. Longer fibres can be however also used for the fibrous material FM.

Within the scope of the invention, the fibrous material can be made solely of pulp, or can also be made of a dry mixture of pulp with other materials (fibres and/or particles). In particular the fibrous material can comprise dry mixture of pulp and particles of superabsorbent material (SAM).

The fibrous material can also comprise staple fibres (natural and/or synthetic), and for example cotton fibres.

In the particular embodiment of FIG. 1, the supplying means 13 comprise a vertical chimney 130 which is pneumatically fed in its upper part with the fibrous material FM. In the lower part of the chimney 130, the supplying means 13 comprises two feeding counter-rotating rolls 131, 132, that longitudinally extend in the cross-machine direction on substantially the whole width of the chimney 130. The lower roll 132 is provided with tooth 132*a* on its whole periphery.

The supplying means 13 also comprise blowing means 134 that comprise a longitudinal slot-type outlet 134*a* extending in the cross-machine direction on substantial the whole width of the chimney. The blowing means 134 are adapted to blow compressed air through the said outlet 134*a*.

The supplying means 13 also comprise a feeding nozzle 133, that is positioned below the feeding roll 132. This nozzle 133 has an outlet 133*a* for the fibrous material MF. Said outlet 133*a* forms a longitudinal slot and is positioned between the die head 104 and the drawing unit 105, and nearby the curtain of meltblown filaments f. This longitudinal slot-type outlet 133*a* extends in the cross-direction direction (direction perpendicular to the FIG. 1) substantially on the whole width of the curtain of meltblown filaments f, in order to feed fibrous material MF substantially on the whole width of the curtain of meltblown filaments f.

In operation, the fibrous material F is stacked in the chimney 130 Compressed air is continuously exhausted by the blowing means 134, through the longitudinal slot-type outlet 134*a*, inside the nozzle 133 (air stream F5). The rolls 131,132 are rotated in order to continuously feed the nozzle 133 with fibrous material MF. Said fibrous material MF is entrained by the air stream F5 generated inside the nozzle 133 by the blowing means 134. At the outlet 133*a* of the nozzle 133, the fibrous material MF is continuously delivered nearby to the curtain of meltblown filaments f.

Thanks to the use of the air-drawing unit 105, the fibrous material MF enters in contact with the meltblown filaments f and is entrained in the drawing unit 105. In addition, thanks to the air flows F4 (FIG. 2) created by the drawing unit 105, the fibrous material FM is also sucked into the channel 1050 of the drawing unit 105, wherein the fibrous material FM is intimately mixed with the polymer filaments f.

At the outlet 1050*b* of the drawing unit 105, the fibrous material FM is advantageously intimately mixed and also partially heat bonded with the meltblown fibres MF. As a result, a fibrous-containing meltblown web MBW is formed onto the surface 11*a* of the conveyor belt 11, wherein the intermingling and bonding of the fibrous material MF with the meltblown fibres MF are improved in comparison for example with the technical solution disclosed in U.S. Pat. No. 4,931,355 and in U.S. Pat. No. 4,939,016 to Radwanski et al. As a result, the loss of fibrous material FM is dramatically reduced when the fibrous-containing meltblown web MBW is subsequently consolidated and/or handled.

In the invention, the use of the additional drawing unit 105 also enables to practice air flows F1 and F2 of lower velocities compared to a standard meltblow equipment having only a meltblown die head without additional drawing unit 105, like for example the meltblow equipment disclosed in U.S. Pat. No. 4,931,355 and in U.S. Pat. No. 4,939,016 to Radwanski et al. By reducing the velocity of the air flows F1 and F2, there is advantageously less risk that the fibrous material FM is being pushed back. As a result, it is advantageously easier to incorporate higher amount of fibrous material inside the meltblown fibres MF.

In the particular embodiment of FIG. 1, the apparatus 1 further comprises consolidation means 14 that are positioned downstream from the meltblow equipment 10. In this particular example, theses pre-consolidation means 14 are constituted by a thermal bonding unit that is known in the prior art. This thermal bonding unit 14 is a calender that comprises two pressure rolls 14*a*, 14*b*. The lower roll 14*b* has a smooth surface, for example a rubber surface. The upper roll 14*a* is a hard steel roll comprising for example an engraved surface with protruding ribs, that are regularly distributed over the whole surface of the roll, and that form a bonding pattern. The two rolls 14*a*, 14*b* are heated in order to obtain a softening of the surface of the meltblown fibres MF, and if appropriate of the fibrous material FM when this fibrous material comprises thermoplastic fibres.

In operation, the conveyor belt 11 is used for transporting and passing the fibrous-containing meltblown nonwoven web MBW between the two rolls 14*a*, 14*b* in order to pre-consolidate the fibrous-containing meltblown nonwoven web by heat and mechanical compression (thermo-bonding).

The invention is not limited however to the use of thermal bonding unit for consolidating the fibrous-containing meltblown nonwoven web MBW, but any other consolidating technique already known in the art can be used, such as for example mechanical bonding, hydroentangling, ultrasonic bonding, air-through bonding, and adhesive bonding.

The hot primary air F1 can be generally obtained like in a standard meltblown process by heating the air with a heat source positioned outside the die head 104. But in another variant of the invention, the heated air can be heated only by the heat generated by the die head 104, when this air passes trough the die head 104.

In another variant of the invention, the apparatus of FIG. 1 can be modified in such a way that the polymeric material is only extruded in the die head 104 in the form of filaments f without the generation of any hot primary air F1. In such a case, only the drawing unit 105 is used for drawing and attenuating the filaments f. In this case, the structure of the die head 104 can be simplified.

In another variant of the invention, the primary air F1 can be generated at low speed in such a way that this primary air is not necessarily used for drawing an attenuating the filaments f at the outlet of the die head 104, but in such a way only to clean the die head 104 and avoid that broken filaments spoil the spinning orifices.

In another variant of the invention, the apparatus of FIG. 1 can be modified in such a way that spunbonded filaments MF are being produced.

The polymer(s) P used for making the fibres MF can be any melt spinnable polymer(s) than can be extruded through a die head. Good candidates are for example polyolefin (in particular homo or copolymer of polypropylene or polyethylene), homo or copolymer of polyester, or homo or copolymer of polyamide or any blend thereof. It can be also advantageously any biodegradable thermoplastic polymer, like for example homo or copolymer of polylactic acid (PLA), or any biodegradable blend comprising a homo or copolymer of PLA. In such a case, when the fibrous material is made of biodegradable material, the nonwoven web MBW is advantageously totally biodegradable.

The fibres MF will be generally non elastic. But elastomeric or elastic fibres MF can be however also used.

The fibres MF can be monocomponent or multicomponent fibres, especially bicomponent fibres, and more especially sheath/core bicomponent fibres. When bicomponent fibres are produced, two extruders are used for feeding simultaneously the die head 104 with each polymer.

Various shapes in cross section for the fibres MF can also be practised (round shape, oval shape, multilobal shape, in particular bilobal shape, trilobal shape, etc. . . . ). The shape in cross section of the meltblown fibres MF is determined by the geometry of the spinning orifices of the die head 104.

Figure 4:
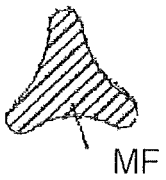
FIG. 4 is view in cross-section of a trilobal meltblown fibre.
Figure 3:
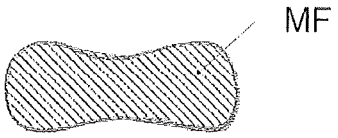
FIG. 3 is a view in cross-section of a bilobal meltblown fibre.

The bonding of the fibrous material FM with the fibres is however surprisingly improved when multilobal-shaped fibres MF are used, especially when bilobal fibres like the one shown in FIG. 3 and also commonly referred as "papillon" fibres are used, or when trilobal fibres like the one shown in FIG. 4 are used.

Figure 5A:
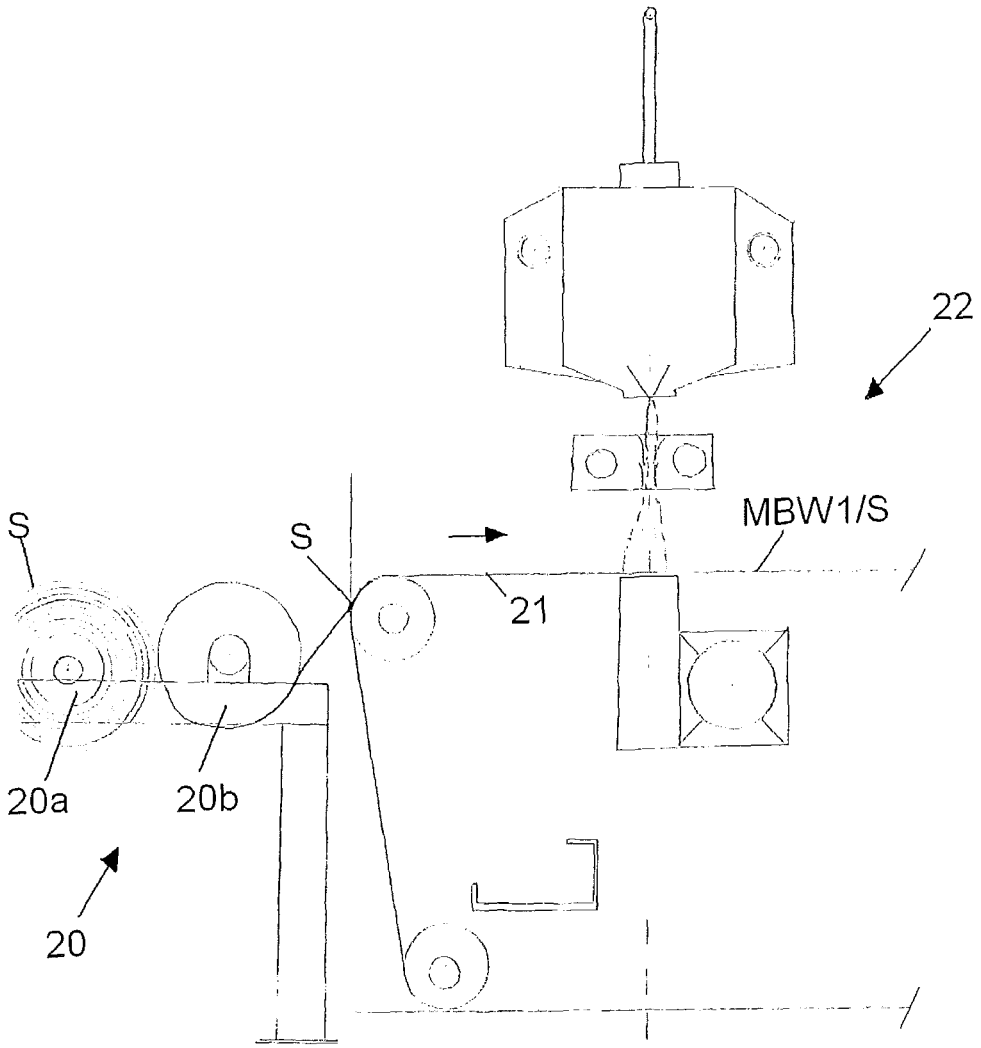
FIGS. 5A to 5C are a schematic representation of a production line adapted to produce a laminate comprising several meltblown nonwoven of the invention.
Figure 5B:
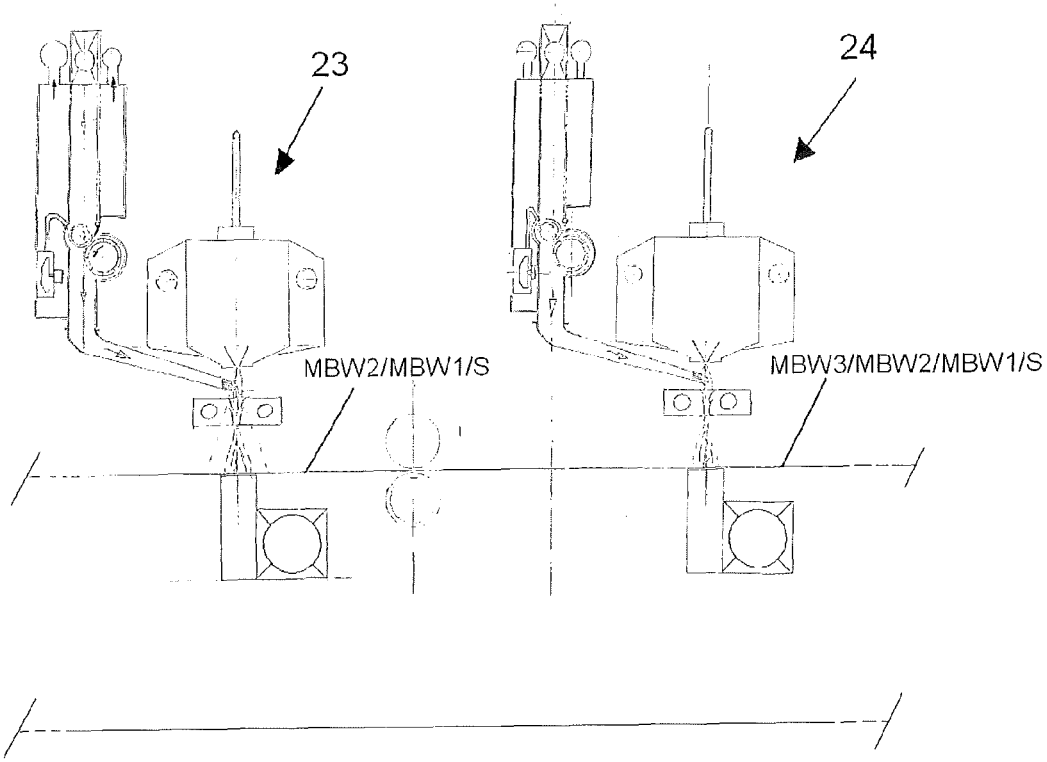
Figure 5C:
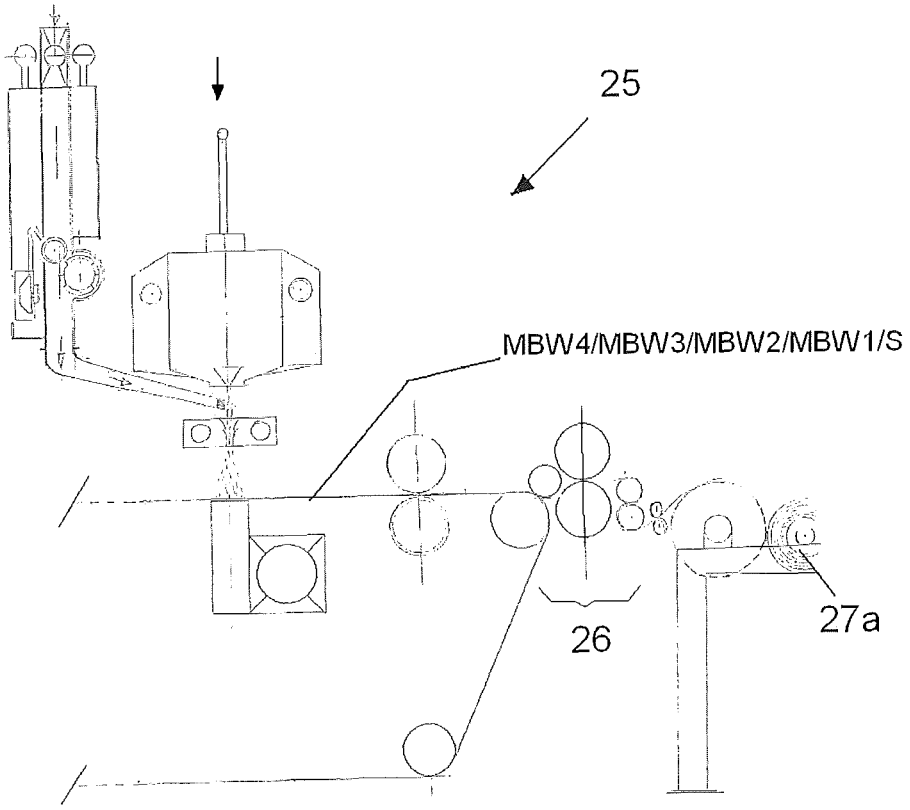

FIGS. 5A to 5C shows an example of a continuous production line for producing a four-layer laminate constituted by a bottom spunbonded nonwoven web S made of continuous spun filaments, a first intermediate meltblown web MBW1, a second intermediate fibrous-containing meltblown web MBW2, a third intermediate fibrous-containing meltblown web MBW3, and top fibrous-containing meltblown web MBW4.

In particular, this production line 2 comprises (FIG. 5A) supplying means 20 for continuously providing the bottom spunbonded nonwoven web S onto a conveyor belt 21. In this particular example, these supplying means 20 comprise a storage roll 20*a* around which the spunbonded nonwoven S is being wounded, and a motorized roll 20*b* associated with the storage roll 20*a* and adapted to continuously unwind the spunbonded nonwoven web S from the storage roll 20*a* and to lay down the spunbonded nonwoven web S onto the conveyor belt 21. These supplying means 20 can also be replaced by a spunbonded unit adapted to produce in line a spunbonded nonwoven web S made of continuous spun filaments that are laid down randomly directly onto the conveyor belt 21.

Upstream from these supplying means 20, the production line 2 comprises successively four apparatus 22, 23 (FIG. 5B), 24 and 25 (FIG. 5C). Apparatus 23, 24, 25 are identical to the apparatus 1 previously described in reference to FIG. 1. The apparatus 22 is similar to the apparatus 1 of FIG. 1, but does not comprise fibrous material supplying means.

The first apparatus 22 is used for continuously spinning the first meltblown web MBW1 directly onto the spunbonded nonwoven web S. The second apparatus 23 is used for continuously spinning the second intermediate fibrous-containing meltblown web MBW2 directly onto the first meltblown web MBW1. The third apparatus 24 is used for continuously spinning the third fibrous-containing meltblown web MBW3 directly onto the second intermediate fibrous-containing meltblown web MBW2. The fourth apparatus 25 is used for continuously spinning the fibrous-containing meltblown web MBW4 directly onto the third intermediate fibrous-containing meltblown web MBW3

The laminate MBW4/MBW3/MBW2/MBW1/S is then subsequently transported to a standard thermal bonding unit 26, in order to heat bond the different layers of the laminate and obtain a consolidated laminate. The consolidated laminate MBW4/MBW3/MBW2/MBW1/S is then knowingly wounded in line around a storage roll 27*a*.

In a preferred embodiment, the meltblown fibres of the first and fourth meltblown nonwoven web MBW1 and MBW4 are bilobal or trilobal and the meltblown fibres of the second and third meltblown nonwoven web MBW2 and MBW3 can have any shape, and in particular can be round. The invention is however not limited to such a particular laminate.

More generally, within the scope of the invention a laminate comprising at least one fibrous-containing meltblown web of the invention, laminated with one or more other layers, including notably spunbonded layer, carded layer, meltblown layer, plastic film, can advantageously be produced.

The fibrous-containing meltblown web of the invention or a laminate comprising at least one fibrous-containing meltblown web of the invention can be used advantageously for making absorbent products, and more particularly dry wipes, or wet wipes, or diapers, or training pants, or sanitary napkins, or incontinence products, or bed pads.

Figure 6:
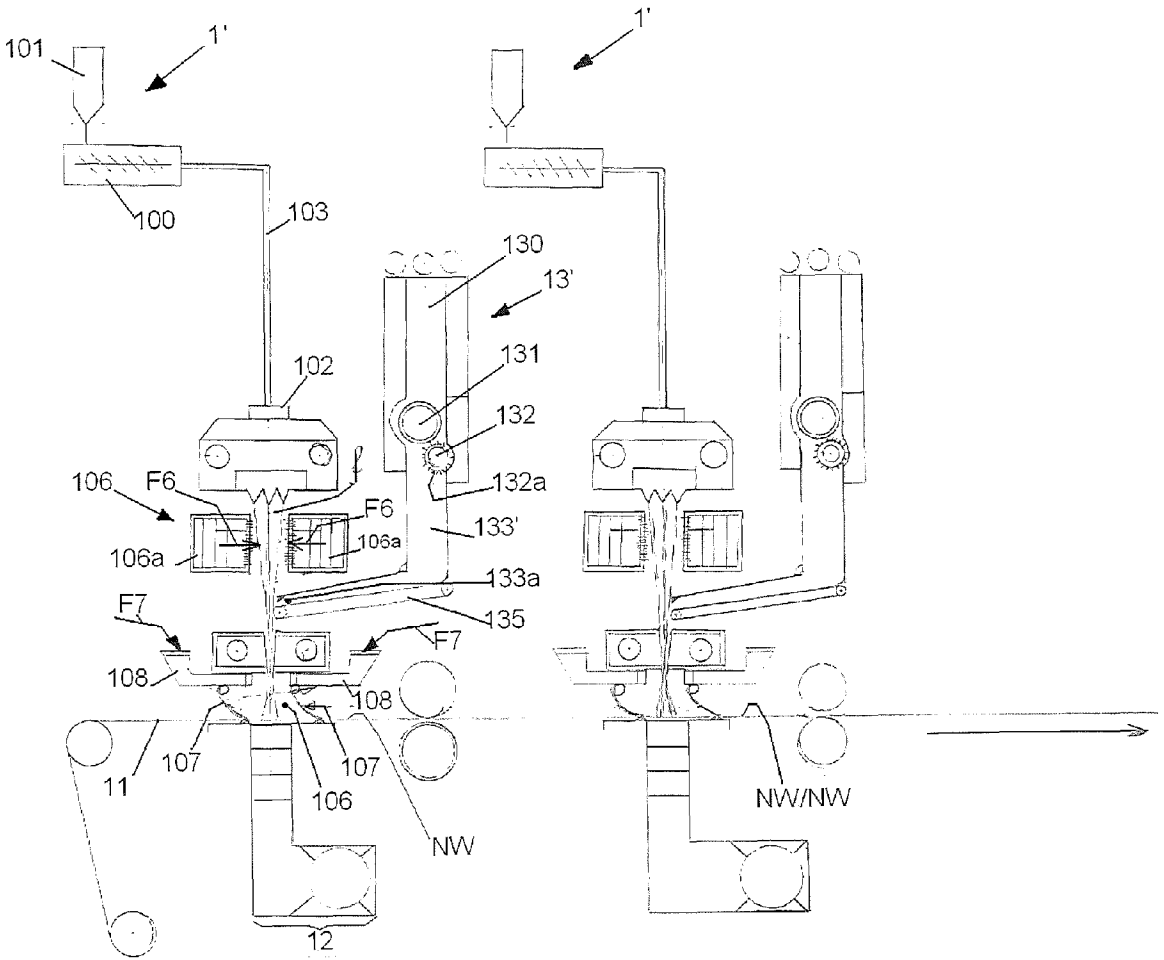
FIG. 6 is a schematic representation of an apparatus according to a second embodiment of the invention, and adapted to produce a fibrous-containing nonwoven.

FIG. 6 shows another variant of a spinning apparatus 1' of the invention that can be used for making a fibrous-containing nonwoven NW.

In this variant, the died head 104' of the spinning apparatus 1' is modified in order to extrude several rows (three rows in this particular example) of polymeric filaments f, instead of one row for the apparatus of FIG. 1. Preferably, in this spinning apparatus 1', there is no generation in the die head 104' of any primary hot air F1, and the polymeric filaments f are only extruded through the spinning orifices of the die head 104'.

A cooling unit 106 is mounted below the outlet of the die head. Said cooling unit 106 comprises two blowing boxes 106*a* positioned on each side of the filaments f and adapted to blow several transverse forced air flows F6 towards the filaments f, in order to cool down and quench the filaments f, in a way similar to the quenching air used in a standard spunbonding apparatus. This quenching air F6 is for example at a temperature between 5° C. and 20° C.

The same drawing unit 105 as the one previously described is being used at a position below the cooling unit 106 for generating the same air flows F3 oriented downstream as the ones previously described, said air flows F3 drawing and attenuating the filaments f.

All the previous explanations made before in connection with the drawing unit 105 of the first embodiment of FIG. 1, and in particular in connection with the use of this drawing unit 105 for breaking the filaments f into non-staple discontinuous fibres MF, also apply to second embodiment of FIG. 6, and will not be repeated.

In the particular embodiment of FIG. 6, fibrous material supplying means 13' are also provided. Said fibrous material supplying means 13' comprise also a vertical chimney 130 which is pneumatically fed in its upper part with the fibrous material FM. In the lower part of the chimney 130, the supplying means 13' comprises two feeding counter-rotating rolls 131, 132, that longitudinally extend in the cross-machine direction on substantially the whole width of the chimney 130. The lower roll 132 is provided with tooth 132*a* on its whole periphery.

The supplying means 13' also comprise a feeding channel 133' that is positioned below the feeding roll 132. This feeding channel 133' has an outlet 133*a* for the fibrous material MF. Said outlet 133*a* forms a longitudinal slot and is positioned between the cooling unit 106 and the drawing unit 105, and nearby the curtains of filaments f. This longitudinal slot-type outlet 133*a* extends in the cross-direction direction (direction perpendicular to the FIG. 6) substantially on the whole width of the curtain of filaments f, in order to feed fibrous material MF substantially on the whole width of the curtains of filaments f.

In contrast with the supplying means 13 of FIG. 1, the supplying means 13' of FIG. 6 do not comprise blowing means 134, but comprise a conveyor belt 135 forming the lower wall of the feeding channel 133' and adapted to transport the fibrous material FM down to the outlet 133*a*.

In operation, the fibrous material F is stacked in the chimney 130. The conveyor belt 135 is continuously rotated. The rolls 131,132 are rotated in order to continuously feed the conveyor belt 135 with fibrous material MF. Said fibrous material MF is entrained by the conveyor belt 135 and is continuously delivered nearby to the curtains of filaments f.

In the variant of FIG. 6, a guiding channel 106 delimited by flaps 107 and air ducts 108 is extending between the outlet of the air drawing unit 105 and the conveyor belt 11. Such a guiding channel 106 has been previously disclosed in US patent application US 2008/0317895 which is incorporated therein by reference. In operation, air is sucked (arrows F7) from the outside of the guiding channel 106 and enters into the guiding channel 106 through air ducts 108, in order to equilibrate the air pressure inside the guiding channel 106. The apparatus of FIG. 1 can also be equipped with such guiding channel 106, flaps 107 and air ducts 108.

In the variant of FIG. 6, two successive spinning apparatus 1' are provided with the same conveyor belt 11. In another variant, the spinning apparatus 1' can be used alone or in combination with any other type of apparatus adapted to laminate any kind of layer (textile layer or film) with the fibrous-containing nonwoven NW produced by the spinning apparatus 1'.

The invention claimed is:

1. An apparatus for making a fibrous-containing nonwoven comprising:

a die head with several spinning orifices:

means for extruding at least one melted polymeric material through the spinning orifices of the die head in the form of filaments;

a drawing unit positioned below the die head, and adapted to create a gas flow that is oriented downstream for drawing and attenuating the filaments; and supplying means for continuously feeding a stream of fibrous material at a position between the die head and the drawing unit, and nearby the filaments.

2. The apparatus of claim 1, wherein the drawing unit is adapted to break the filaments into discontinuous fibres.

3. The apparatus of claim 2, wherein the drawing unit is adapted to break the filaments into discontinuous fibres having an average length higher than 20 mm and not more than 250 mm.

4. The apparatus of claim 3, wherein the drawing unit is adapted to break the filaments into discontinuous fibres having an average length greater than 40 mm and not more than 150 mm.

5. The apparatus of claim 1, wherein the drawing unit comprises a channel that is positioned below the die head, in such a way that the filaments delivered by the die head can pass through the channel, and air blowing means adapted to blow the gas flow inside the channel.

6. The apparatus of claim 5, wherein the drawing unit is adapted to create above the drawing unit a sucked air flow that enters into the channel.

7. The apparatus of claim 1, wherein the distance between the outlet of the die head and the inlet of the drawing unit is adjustable.

8. The apparatus of claim 1, wherein whole or part of the spinning orifices of the die head are non circular orifices.

9. The apparatus of claim 1, wherein whole or part of the spinning orifices of the die head are multilobal.

10. The apparatus of claim 1, further comprising a movable surface positioned below the drawing unit.

11. The apparatus of claim 1 wherein the die head is adapted to extrude vertical filaments, and the gas flow is oriented downwardly.

12. The apparatus of claim 1, further comprising cooling means for blowing a quenching air towards the filaments at a position between the die head and the drawing unit.

13. The apparatus of claim 1, wherein the die head does not comprise blowing means for blowing a hot primary gas flow towards the outlet of the die head.

14. The apparatus of claim 1, further comprising means for blowing a hot primary gas flow towards the outlet of the die head in order to form meltblown filaments.

15. The apparatus of claim 1, further comprising a thermal bonding unit for thermo-bonding the fibrous-containing nonwoven.

16. The apparatus of claim 1, wherein the supplying means includes a conveyor belt for continuously delivering the fibrous material.

17. The apparatus of claim 9, wherein all or part of the spinning orifice of the die head is bilobal.

18. The apparatus of claim 9, wherein all or part of the spinning orifice of the die head is trilobal.

* * * * *